US011060402B2

(12) United States Patent
Li et al.

(10) Patent No.: US 11,060,402 B2
(45) Date of Patent: Jul. 13, 2021

(54) METHOD FOR CLASSIFYING PHREATIC LEAKAGE DISASTER LEVEL IN SHALLOW COAL SEAM MINING

(71) Applicant: CHINA UNIVERSITY OF MINING AND TECHNOLOGY, Xuzhou (CN)

(72) Inventors: Wenping Li, Xuzhou (CN); Weichi Chen, Xuzhou (CN); Zhi Yang, Xuzhou (CN); Qiqing Wang, Xuzhou (CN); Kaifang Fan, Xuzhou (CN)

(73) Assignee: CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 7 days.

(21) Appl. No.: 16/609,738

(22) PCT Filed: Jan. 25, 2019

(86) PCT No.: PCT/CN2019/073162

§ 371 (c)(1),
(2) Date: Oct. 30, 2019

(87) PCT Pub. No.: WO2020/029557

PCT Pub. Date: Feb. 13, 2020

(65) Prior Publication Data

US 2020/0378258 A1 Dec. 3, 2020

(30) Foreign Application Priority Data

Aug. 9, 2018 (CN) ..... 201810901441.7

(51) Int. Cl.
*E21F 17/00* (2006.01)
*E21F 17/18* (2006.01)
*E21C 39/00* (2006.01)

(52) U.S. Cl.
CPC ..... *E21F 17/18* (2013.01); *E21C 39/00* (2013.01)

(58) Field of Classification Search
CPC ..... E21F 17/18
See application file for complete search history.

(56) References Cited

U.S. PATENT DOCUMENTS 10,053,985 B1 * 8/2018 Peng ..... B09B 1/006

FOREIGN PATENT DOCUMENTS

CN 107764758 A 3/2018
CN 108316924 A 7/2018
(Continued)

OTHER PUBLICATIONS

Shuangming Wang et. al,Symposium: Mining Safety & Environmental ProtectionG et. al, Division of Coal Mining Conditions Based on Ecological Water Level Protection for Northern Shaanxi, Symposium: Mining Safety & Environmental Protection, Jun. 10, 2010, pp. 81-83.

(Continued)

*Primary Examiner* — Janine M Kreck
(74) *Attorney, Agent, or Firm* — Bayramoglu Law Offices LLC

(57) ABSTRACT

A method for classifying a phreatic leakage disaster level in shallow coal seam mining includes the following steps: S1. arranging a monitoring hole in a coal mine working face and burying a telemetering water level gauge to perform water level monitoring; S2. monitoring a ground elevation, calculating a ground subsidence amount, and collecting mining advance distance information; S3. plotting variation relationship curves of mining advance distance and phreatic water level as well as mining advance distance and ground subsidence according to monitored information, respectively; and S4. comparing the curves with a no-leakage graph, a slight-leakage graph, and a heavy-leakage graph, and determining a leakage level; and S5. further classifying (Continued)

a studied area as an environmental disaster area or an environmentally friendly area.

16 Claims, 4 Drawing Sheets

(56) References Cited

FOREIGN PATENT DOCUMENTS

| | | | |
|---|---|---|---|
| CN | 109098753 | A | 12/2018 |
| DE | 102008045459 | A1 | 3/2010 |
| RU | 2499142 | C2 | 11/2013 |

OTHER PUBLICATIONS

Ze-Yuan Yang et. al, Research on buried depth of eco-safety about groundwater table in the blown-sand region of the Northern Shaanxi Province, Jour. of Northwest Sci-Tech Univ. of Agri. and For. (Nat. Sci. Ed.), Aug. 2006, pp: 67-74, vol. 34.

* cited by examiner

METHOD FOR CLASSIFYING PHREATIC LEAKAGE DISASTER LEVEL IN SHALLOW COAL SEAM MINING

CROSS REFERENCE TO THE RELATED APPLICATIONS

This application is the national phase entry of the International Application No. PCT/CN2019/073162, filed on Jan. 25, 2019, which is based upon and claimed priority to Chinese Patent Application No. 201810901441.7, filed on Aug. 9, 2018, the entire contents of which are incorporated herein by reference.

TECHNICAL FIELD

The present invention relates to the field of ecological protection technologies, and in particular, to a method for classifying a phreatic leakage disaster level in shallow coal seam mining.

BACKGROUND

Since coal resources in eastern China are gradually depleted, strategic westward moving of coal production will be continuously accelerated, so that a coal mining amount in western China will increase year by year. It is expected that a coal yield in western China will account for more than 70% of a total coal yield of China in the future. The reserves of coal resources in northern Shaanxi are extremely large, the coal quality is good, and a mining prospect is prosperous. At the same time, northern Shaanxi belongs to an arid-semiarid region, water resources are generally seriously insufficient, and the ecological and geological environment is fragile, which brings serious constraints and impacts on regional economy and social development. The Upper Pleistocene Sarawusu formation sand layer phreatic water with a large area distributed in the Mu Us desert beach in a northern Shaanxi coalfield is an important water source for maintaining ecological vegetation. However, for more than ten years, coal mining has caused extensive damage to the phreatic water resources in the area, gullies have been cut off, and water volumes of springs and lakes are reduced or the springs and lakes are even dried up, resulting in problems in water for industrial and agricultural use and environmental problems such as surface drought, vegetation wilting, and intensified desertification. Therefore, the Sarawusu formation sand layer phreatic water has become an important research subject of ecological and environmental protection in an arid-semiarid region of northern Shaanxi.

In recent years, the domestic geological community has carried out a lot of researches on the problem of water-preserved coal mining in the Jurassic coalfield in western China. Strategies and methods for water-preserved coal mining are discussed. A new viewpoint that a core of water-preserved coal mining is ecological water level protection is put forwarded. With regard to how to deal with a coordination relationship between coal mining and groundwater, more proper coal mining methods and engineering measures need to be used to achieve water-retaining coal mining. That is, problems about a water preservation degree, a way of water-retaining coal mining, and the like still need to be further researched. Whether shallow groundwater level lowering is caused by lateral recharge or vertical seepage can be clearly determined by using a monitored water level of a telemetering water level gauge, thereby classifying a phreatic leakage degree and a degree of affecting ecological vegetation, providing a basic basis for work such as mining area planning, and selecting a mining manner, and having significance of carrying out mining while protecting an ecological environment of an arid-semiarid region.

SUMMARY

In view of the analysis above, the present invention aims at providing a method for classifying a phreatic leakage disaster level in shallow coal seam mining and is used to resolve a problem of a failure in accurately determining a phreatic leakage disaster level in coal mining areas. In addition, a corresponding water-preserved mining solution is formulated according to a phreatic leakage and a classified disaster level, thereby minimizing a level of damage to an ecological environment caused by mining.

An objective of the present invention is mainly achieved by using the technical solutions:

A method for classifying a phreatic leakage disaster level in shallow coal seam mining is provided, including the following steps:

S1. collecting a mine plan of a to-be-mined coal seam working face in a mining area, arranging a monitoring point, and burying a telemetering water level gauge to monitor a water level;

S2. according to the monitoring point arranged in step S1, during working face mining, monitoring a ground elevation at the monitoring point, calculating a ground subsidence amount, and collecting information about a mining advance distance of the working face;

S3. plotting variation relationship curves of mining advance distance and phreatic water level as well as mining advance distance and ground subsidence according to the working face mining advance distance and the ground subsidence amount that are obtained in step S2 and water level monitoring information obtained in step S1; and

S4. comparing the curve with a no-phreatic leakage graph, a slight-phreatic leakage graph, and a heavy-phreatic leakage graph; and classifying a mined coal seam working face as a no-phreatic leakage area, a slight-phreatic leakage area, or a heavy-phreatic leakage area.

Further, in the step S1, a location for arranging the monitoring point of the working face is located at the center of the working face, a used telemetering water level gauge satisfies requirements of "Instruments for stage measurement. Part 6: remote measuring stage gauge" (GB/T11828.6-2008), a buried depth of a probe of the water level gauge is located below a monitored water level during a mining process, and water level monitoring is performed immediately after the water level gauge is completely buried.

Further, in the step S2, ground subsidence observation at the monitoring point is started when the distance between the mining advance distance and the monitoring point is L, and ended when the monitored data becomes steady, that is, an accumulated ground subsidence amount continuously monitored in 5 days is less than 0.01 m, where a formula for calculating L is as follows:

$$L = \frac{h}{\tan w},$$

where

L is an advanced influence distance, in m; h is a mining depth, in m; and w is an advanced influence angle, in °.

According to mining depths and advanced influence angles of different mining working faces, start times of ground subsidence observation of different mining working faces are determined, and a first stage of ground subsidence, namely, a non-subsiding stage, is determined efficiently and accurately. A monitoring end time is a time when an accumulated ground subsidence amount continuously monitored in 5 days is less than 0.01 m. At this time, it can be considered in the art that the subsidence ends, and it is unnecessary to continue monitoring.

Further, in the step S2, a formula for calculating a ground subsidence amount at the monitoring point is as follows.

$\Delta H = He0 - He$, where

ΔH is a ground subsidence amount, in m; He0 is an initial ground elevation at the monitoring point, in m; and He is a ground elevation at the monitoring point during a mining process, in m.

Further, the step S2, the precision of monitoring of a ground elevation at the monitoring point is 0.001 m. In this precision, accuracy of the monitored data of the ground elevation at the monitoring point and accuracy of subsequently determining an end time of monitoring the ground elevation are ensured.

Further, in the step S4, a ground subsidence variation curve in each of the no-phreatic leakage graph, the slight-phreatic leakage graph, and the heavy-phreatic leakage graph is divided into five stages: stage 1: a non-subsiding stage, stage 2: a slow subsiding stage, stage 3: an accelerated subsiding stage, stage 4: a slowed-down subsiding stage, and stage 5: a steady subsiding stage;

a water level variation curve in the no-phreatic leakage graph is divided into: stage a: a rapid water level lowering stage, stage b: a transient steady water level stage, stage c: a rapid water level rising stage, stage d: a slow water level rising stage, and stage e: a steady water level stage; a water level variation curve in the slight-phreatic leakage graph is divided into: stage a: a rapid water level lowering stage, stage b: a transient steady water level stage, stage d: a slow water level rising stage, and stage e: a steady water level stage; and a water level variation curve in the heavy-phreatic leakage graph is divided into: stage a: rapid water level lowering stage.

Further, to better classify a phreatic leakage disaster level of a mining coal seam working face, the foregoing classifying method further includes the following step:

S5. defining the no-phreatic leakage area as an environmentally friendly area, defining the heavy-phreatic leakage area as an environmental disaster area, calculating a water level buried depth of the slight-phreatic leakage area in step S4, if the water level buried depth is deeper than a local ecological water level buried depth, classifying the mining coal seam working face as an environmental disaster area, and if the water level buried depth is shallower than the local ecological water level buried depth, classifying the mining coal seam working face as an environmentally friendly area.

Further, a formula for calculating a water level buried depth of the slight-phreatic leakage area in step S4 is as follows:

$S = He0 - Hw$, where

S is the water level buried depth, in m; He0 is the initial ground elevation at the monitoring point, in m; and Hw is a monitoring level of the telemetering water level gauge, in m.

Further, the ecological water level is a groundwater level buried depth capable of maintaining good development and growth of typical vegetation, and the ecological water level is determined according to typical ground cover vegetation of the coal mining area.

Further, the method for classifying a phreatic leakage disaster level of a coal mining working face is applicable to a northwest coalfield.

(1) In the method for classifying a phreatic leakage disaster level in shallow coal seam mining, provided in the present invention, a phreatic leakage level over a coal mining area is directly determined and classified, and further, a coal mining working face is classified as an environmentally friendly area and an environmental disaster area, thereby providing an explicit basis for choosing a mining solution in a mining area. For the mining area, a corresponding water-preserved mining solution may be formulated according to a phreatic leakage disaster level, thereby minimizing damage to an ecological environment caused by mining.

(2) The classifying method of the present invention is simple and practical, where from a perspective of ecological protection, a water resource loss and an environmental disaster is determined for a shallow seam of a northwest coalfield, and a basis is provided for a choice of a mining manner in a mining area, and the method is of significance for ecological and environmental protection in a mining process of the northwest coalfield.

In the present invention, the foregoing technical solutions may alternatively be mutually combined, to implement more preferred combined solutions. Other features and advantages of the present invention are described below in the description, and some advantages may become obvious from the description or may be obtained by implementing the present invention. The objectives and other advantages of the present invention may be achieved and obtained from the content specified in the description, claims, and accompanying drawings.

BRIEF DESCRIPTION OF THE DRAWINGS

The accompanying drawings are merely used for the purpose of illustrating specific embodiments, and are not to be construed as limitations to the present invention. In all the accompanying drawings, the same reference numeral indicates the same component.

DETAILED DESCRIPTION OF THE EMBODIMENTS

Preferred embodiments of the present invention are specifically described below with reference to the accompanying drawings, where the accompanying drawings constitute a part of the present application, and are used together with the embodiments of the present invention to explain the principle of the present invention, and are not intended to limit the scope of the present invention.

Figure 1:
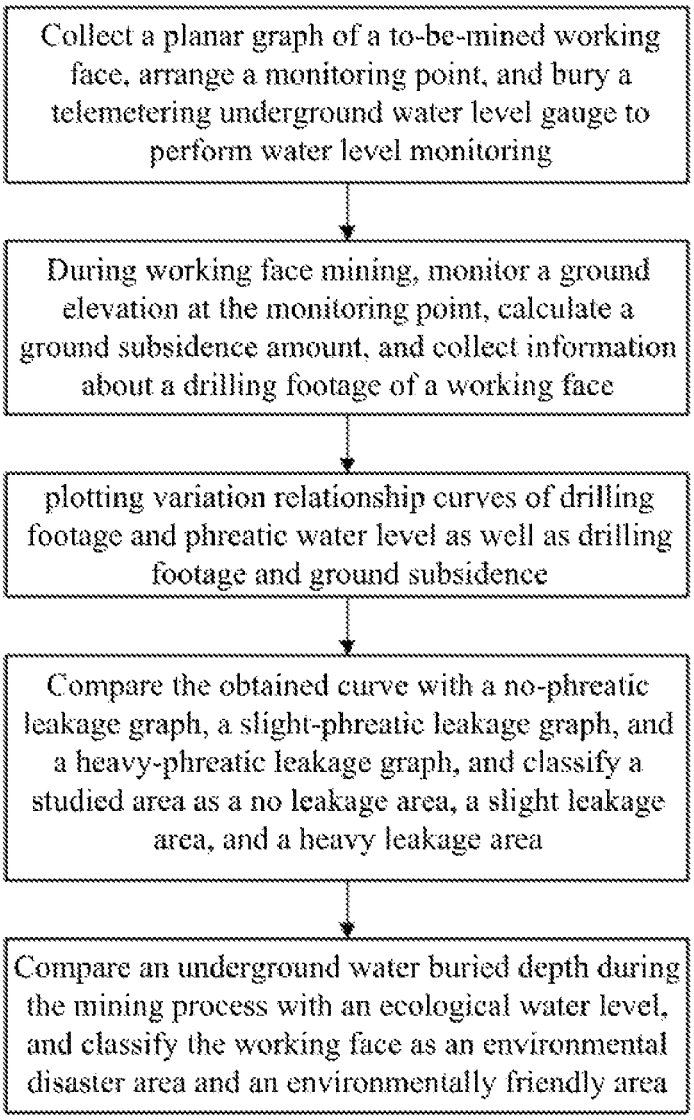
FIG. 1 shows a flowchart of implementation of a method according to the present invention.

The present invention provides a method for classifying a phreatic leakage disaster level in shallow coal seam mining, as shown in FIG. 1, including the following steps:

S1. Collect a mine plan of a to-be-mined coal seam working face in a mining area, arrange a monitoring point, and bury a telemetering water level gauge.

The step specifically includes: collecting a mine plan of a to-be-mined working face, arranging a monitoring point at the center of the working face, where the used telemetering water level gauge satisfies requirements of "Instruments for stage measurement. Part 6: remote measuring stage gauge" (GB/T11828.6-2008), and a buried depth of a probe of the water level gauge is located below a monitored water level during a mining process, and performing water level monitoring immediately after the water level gauge is completely buried.

S2. According to the monitoring point arranged in step S1, during working face mining, observe a ground elevation at the monitoring point, calculate a ground subsidence amount, and collect information about a mining advance distance of the working face.

The step specifically includes that: a start time of monitoring the ground subsidence amount at the monitoring point is a time when the distance between the mining advance distance and the monitoring point is L, and an end time thereof is a time when the monitored data becomes steady, that is, an accumulated ground subsidence amount continuously monitored in 5 days is less than 0.01 m; and the precision of monitoring of the ground subsidence is 0.001 m. A formula for calculating L is as follows:

$$L = \frac{h}{\tan w},$$

where

L is an advanced influence distance, in m; h is a mining depth, in m; and w is an advanced influence angle, in °.

A formula for calculating a ground subsidence amount at the monitoring point is as follows:

$\Delta H = He0 - He$, where

ΔH is a ground subsidence amount, in m; He0 is an initial ground elevation at the monitoring point, in m; and He is a ground elevation at the monitoring point during a mining process, in m.

S3. Plot variation relationship curves of mining advance distance and phreatic water level as well as mining advance distance and ground subsidence according to the working face mining advance distance and the ground subsidence amount that are obtained in step S2 and water level monitoring information obtained in step S1.

S4. Compare the curve with a no-phreatic leakage graph, a slight-phreatic leakage graph, and a heavy-phreatic leakage graph; and classify a mined coal seam working face as a no-phreatic leakage area, a slight-phreatic leakage area, and a heavy-phreatic leakage area.

The foregoing no-phreatic leakage graph, slight-phreatic leakage graph, and heavy-phreatic leakage graph are rules generalized from the monitored information (working face mining advance distance data, water level gauge data, and ground subsidence data) of a plurality of coal mines in northwest China, and a classification basis is a correspondence between ground subsidence and a water level.

Figure 2:
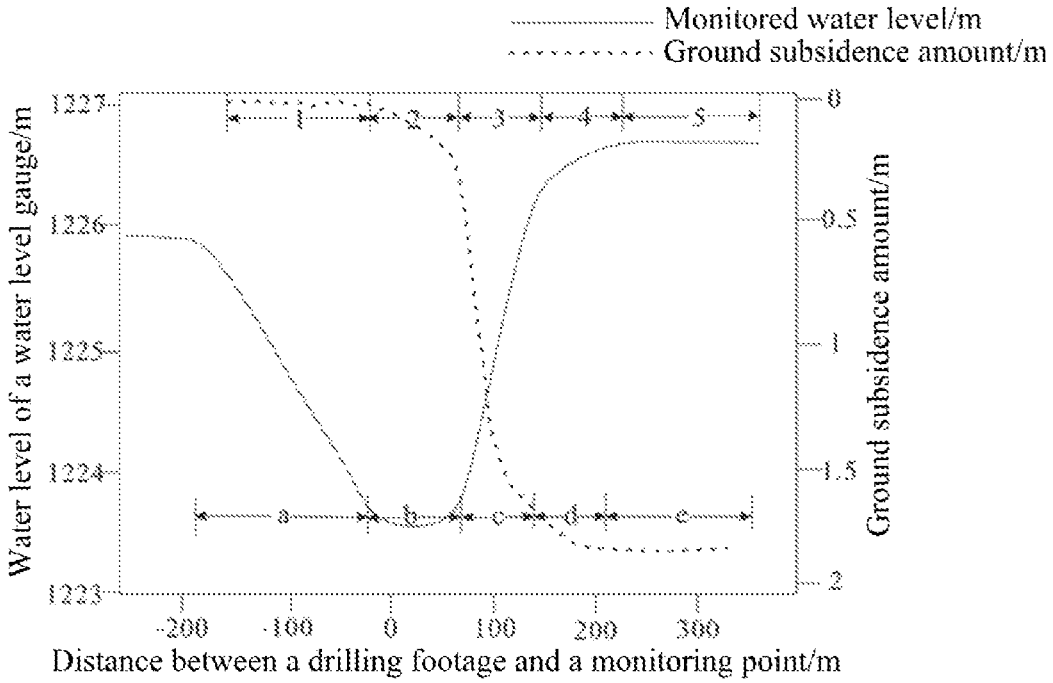
FIG. 2 shows a no-phreatic leakage area graph, in which a distance between a mining advance distance and a monitoring point being a negative value indicates that the monitoring point has not been mined, and the distance being a positive value indicates that the monitoring point has been mined.

As shown in FIG. 2, a ground subsidence variation curve in the no-phreatic leakage graph is divided into five stages: stage 1: a non-subsiding stage, stage 2: a slow subsiding stage, stage 3: an accelerated subsiding stage, stage 4: a slowed-down subsiding stage, and stage 5: a steady subsiding stage. A water level variation curve is divided into: stage a: a rapid water level lowering stage, stage b: a transient steady water level stage, stage c: a rapid water level rising stage, stage d: a slow water level rising stage, and stage e: a steady water level stage.

Figure 3:
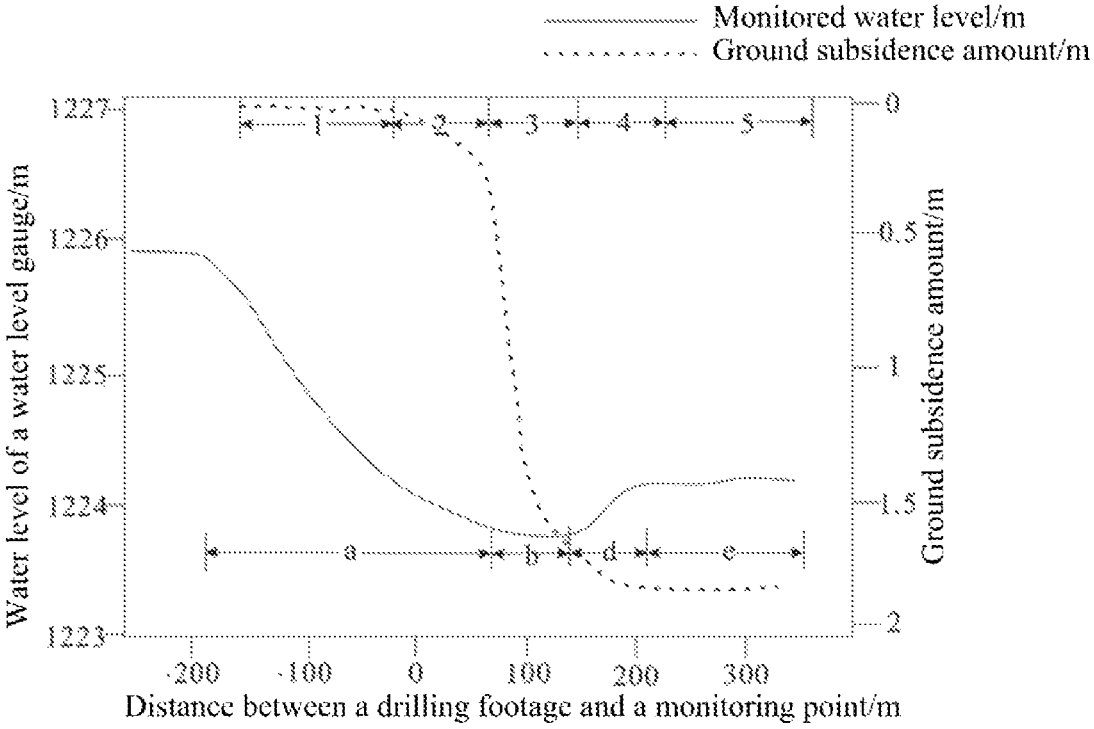
FIG. 3 shows a slight-phreatic leakage area graph, in which a distance between a mining advance distance and a monitoring point being a negative value indicates that the monitoring point has not been mined, and the distance being a positive value indicates that the monitoring point has been mined.

As shown in FIG. 3, a ground subsidence variation curve in the slight-phreatic leakage graph is divided into five stages: stage 1: a non-subsiding stage, stage 2: a slow subsiding stage, stage 3: an accelerated subsiding stage, stage 4: a slowed-down subsiding stage, and stage 5: a steady subsiding stage. A water level variation curve is divided into: stage a: a rapid water level lowering stage, stage b: a transient steady water level stage, stage d: a slow water level rising stage, and stage e: a steady water level stage.

Figure 4:
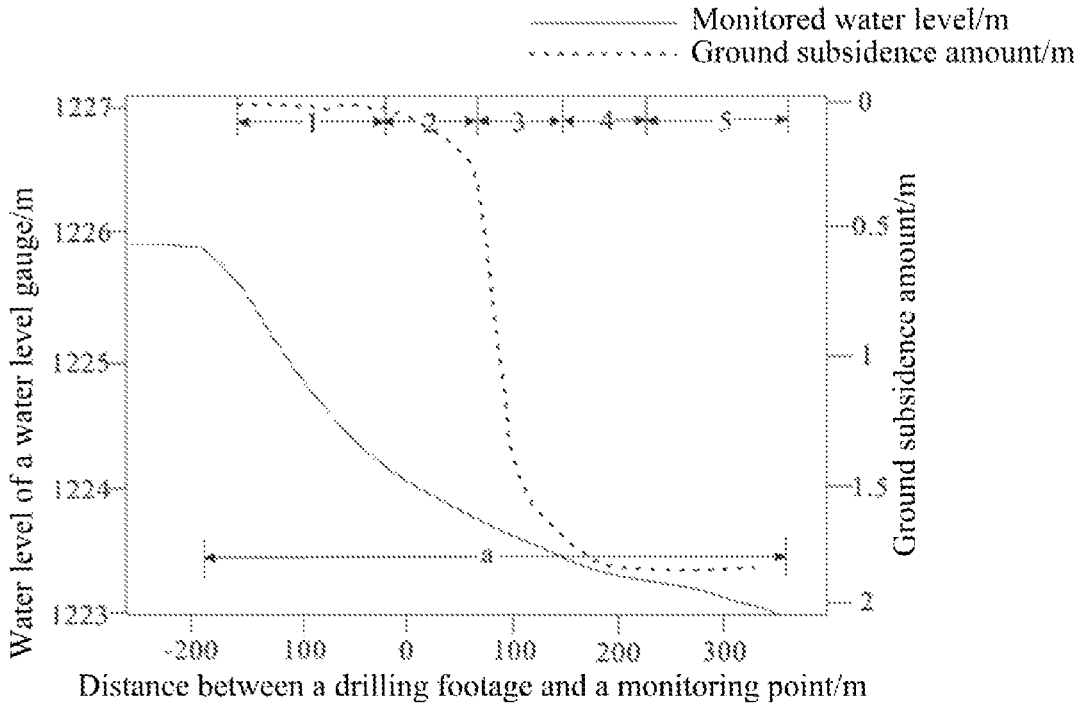
FIG. 4 shows a heavy-phreatic leakage area graph, in which a distance between a mining advance distance and a monitoring point being a negative value indicates that the monitoring point has not been mined, and the distance being a positive value indicates that the monitoring point has been mined.

As shown in FIG. 4, a ground subsidence variation curve in the heavy-phreatic leakage graph is divided into five stages: stage 1: a non-subsiding stage, stage 2: a slow subsiding stage, stage 3: an accelerated subsiding stage, stage 4: a slowed-down subsiding stage, and stage 5: a steady subsiding stage. A water level variation curve is divided into: stage a: a rapid water level lowering stage.

Stage 1 in all of the three basic graphs corresponds to stage a, indicating that the coal mining activity in front of the mining area leads to a decrease in the water level at the monitoring point. At this time, it cannot be determined whether the water level is lowered because of the foregoing phreatic leakage of the mining area or the lateral recharge caused by the ground subsidence. In FIG. 2, stage 2 corresponds to stage b, that is, the ground at the monitoring point slightly subsides, and a water level of the water level gauge is not lowered, indicating that there is no-phreatic leakage in the mode of FIG. 2. A transient steady water level is caused by receiving a water level recharge from an area that has not been mined at the monitoring point because of ground subsidence, and stage 3 corresponds to stage c, in which the ground subsidence is severe, and the water level begins to rise sharply. Stage 4 corresponds to stage d, in which the ground subsidence is slow, and the water level rises slowly. Stage 5 corresponds to stage e, in which the ground subsidence ends, and the water level is also steady. The phenomena indicate that the variation of the water level at the monitoring point is not caused by a loss or subsidence. Therefore, FIG. 2 is defined as a no-phreatic leakage area, Stage 2 in both of FIG. 3 and FIG. 4 corresponds to stage a, but stage 3 in FIG. 3 corresponds to stage b, in which the water level can be ensured to be steady only when a large amount of lateral water supply is received, indicating that a loss occurs in the mode of FIG. 3, but is not severe, and a balance may be achieved by supply of lateral water. In stage 4, a small amount of supplied water leads to that a water volume slightly rises. Therefore, FIG. 3 is defined as a slight-phreatic leakage area. In FIG. 4, the water level never rises, indicating that even if lateral supply is received, the water level cannot be restored, which indicates that a heavy loss occurs. Therefore, FIG. 4 is defined as a heavy-phreatic leakage area.

To better classify a phreatic leakage disaster level of a mining coal seam working face, the foregoing classifying method further includes the following step:

S5. Define the no-phreatic leakage area as an environmentally friendly area, define the heavy-phreatic leakage area as an environmental disaster area, calculate a water level buried depth of the slight-phreatic leakage area in step S4, if the water level buried depth is deeper than a local ecological water level buried depth, classify the mining coal seam working face as an environmental disaster area, and if the water level buried depth is shallower than the local ecological water level buried depth, classify the mining coal seam working face as an environmentally friendly area. A formula for calculating a water level buried depth of the slight-phreatic leakage area in step S4 is as follows:

$S=He0-Hw$, where

S is the water level buried depth, in m; He0 is the initial ground elevation at the monitoring point, in m; and Hw is a monitoring level of the telemetering water level gauge, in m.

It should be noted that the ecological water level is a groundwater level buried depth capable of maintaining good development and growth of typical vegetation, and the ecological water level is determined according to typical ground cover vegetation of the coal mining area.

Embodiment 1

The technical solution of the present invention is described below in detail with reference to a specific example.

Figure 5:
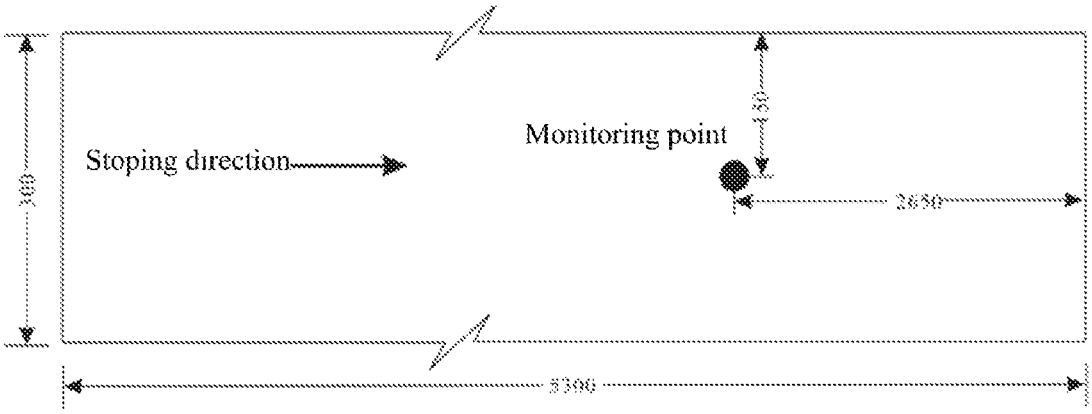
FIG. 5 shows a mine plan of a working face of a Jinjitan coal mine.

FIG. 5 shows a coal-mining working face of a Jinjitan coal mine. The coal-mining working face of the Jinjitan coal mine has a length of 5300 m and a width of 300 m, and the working face was stopped in June 2016 at an average stopping speed of 10 m/d. A location for arranging the monitoring point is located at the center of the working face, and after being completely buried on Jan. 3, 2017, a water level gauge performs automatic water level monitoring, where a probe of a water level gauge is located 15 m below an initial water level, thereby ensuring that a water level variation can be monitored at any time during a mining process. In this case, a distance between a mining advance distance and the monitoring point is −265 m (a negative value indicates that the monitoring point has not been mined, and a positive value indicates that the monitoring point has been mined). A water level Hw of the water level gauge is recorded as shown in Table 1.

TABLE 1

Monitored data and calculated data of a working face of a Jinjitan coal mine

| Distance between a drilling footage and a monitoring point/m | Water level of a water level gauge Hw/m | Water level buried depth s/m | Ground elevation He/m | Ground subsidence ΔH/m |
|---|---|---|---|---|
| −265 | 1225.80 | 1.01 | — | — |
| −260 | 1225.90 | 0.91 | — | — |
| −255 | 1225.89 | 0.92 | — | — |
| −250 | 1225.84 | 0.97 | — | — |
| −245 | 1225.84 | 0.97 | — | — |
| −240 | 1225.88 | 0.93 | — | — |
| −235 | 1225.85 | 0.96 | — | — |
| −230 | 1225.86 | 0.95 | — | — |
| −225 | 1225.91 | 0.90 | — | — |
| −220 | 1225.84 | 0.97 | — | — |
| −215 | 1225.82 | 0.99 | — | — |
| −210 | 1225.84 | 0.97 | — | — |
| −205 | 1225.83 | 0.98 | — | — |
| −200 | 1225.80 | 1.01 | — | — |
| −195 | 1225.77 | 1.04 | — | — |
| −190 | 1225.82 | 0.99 | — | — |
| −185 | 1225.84 | 0.97 | — | — |
| −180 | 1225.79 | 1.02 | — | — |
| −175 | 1225.77 | 1.04 | — | — |
| −170 | 1225.73 | 1.08 | — | — |
| −165 | 1225.72 | 1.09 | — | — |
| −160 | 1225.67 | 1.14 | — | — |
| −155 | 1225.62 | 1.19 | — | — |
| −150 | 1225.58 | 1.23 | 1226.787 | 0.023 |
| −145 | 1225.56 | 1.25 | 1226.796 | 0.014 |
| −140 | 1225.44 | 1.37 | 1226.776 | 0.034 |
| −135 | 1225.47 | 1.34 | 1226.772 | 0.038 |
| −130 | 1225.43 | 1.38 | 1226.763 | 0.047 |
| −125 | 1225.44 | 1.37 | 1226.750 | 0.060 |
| −120 | 1225.34 | 1.47 | 1226.760 | 0.050 |
| −115 | 1225.27 | 1.54 | 1226.760 | 0.050 |
| −110 | 1225.28 | 1.53 | 1226.786 | 0.024 |
| −105 | 1225.28 | 1.53 | 1226.779 | 0.031 |
| −100 | 1225.21 | 1.60 | 1226.757 | 0.053 |
| −95 | 1225.15 | 1.66 | 1226.762 | 0.048 |
| −90 | 1225.19 | 1.62 | 1226.755 | 0.055 |
| −85 | 1225.15 | 1.66 | 1226.724 | 0.086 |
| −80 | 1225.02 | 1.79 | 1226.746 | 0.064 |
| −75 | 1225.02 | 1.79 | 1226.748 | 0.062 |
| −70 | 1225.98 | 1.83 | 1226.750 | 0.060 |
| −65 | 1225.91 | 1.90 | 1226.740 | 0.070 |
| −60 | 1225.89 | 1.92 | 1226.784 | 0.026 |
| −55 | 1225.85 | 1.96 | 1226.720 | 0.090 |
| −50 | 1225.86 | 1.95 | 1226.685 | 0.125 |
| −45 | 1225.86 | 1.95 | 1226.723 | 0.087 |
| −40 | 1225.77 | 2.04 | 1226.703 | 0.107 |
| −35 | 1225.73 | 2.08 | 1226.718 | 0.092 |
| −30 | 1225.72 | 2.09 | 1226.771 | 0.039 |
| −25 | 1225.66 | 2.15 | 1226.702 | 0.108 |
| −20 | 1225.56 | 2.25 | 1226.654 | 0.156 |
| −15 | 1225.52 | 2.29 | 1226.683 | 0.127 |
| −10 | 1225.52 | 2.29 | 1226.610 | 0.200 |
| −5 | 1225.53 | 2.28 | 1226.643 | 0.023 |
| 0 | 1225.50 | 2.31 | 1226.455 | 0.023 |
| 5 | 1225.53 | 2.28 | 1226.405 | 0.405 |
| 10 | 1224.49 | 2.32 | 1226.369 | 0.441 |
| 15 | 1224.54 | 2.27 | 1226.346 | 0.464 |
| 20 | 1224.51 | 2.30 | 1226.193 | 0.617 |
| 25 | 1224.48 | 2.33 | 1226.043 | 0.767 |
| 30 | 1224.53 | 2.28 | 1225.648 | 1.162 |
| 35 | 1224.49 | 2.32 | 1225.477 | 1.333 |
| 40 | 1224.54 | 2.27 | 1225.339 | 1.471 |
| 45 | 1224.50 | 2.31 | 1225.059 | 1.751 |
| 50 | 1224.47 | 2.34 | 1224.970 | 1.840 |
| 55 | 1224.52 | 2.29 | 1224.896 | 1.914 |
| 60 | 1224.49 | 2.32 | 1224.854 | 1.956 |
| 65 | 1224.53 | 2.28 | 1224.680 | 2.130 |
| 70 | 1224.54 | 2.27 | 1224.623 | 2.187 |
| 75 | 1224.62 | 2.19 | 1224.573 | 2.237 |

TABLE 1-continued

| Monitored data and calculated data of a working face of a Jinjitan coal mine | | | | |
|---|---|---|---|---|
| Distance between a drilling footage and a monitoring point/m | Water level of a water level gauge Hw/m | Water level buried depth s/m | Ground elevation He/m | Ground subsidence ΔH/m |
| 80 | 1224.69 | 2.12 | 1224.528 | 2.282 |
| 85 | 1224.70 | 2.11 | 1224.487 | 2.323 |
| 90 | 1224.67 | 2.14 | 1224.449 | 2.361 |
| 95 | 1224.69 | 2.12 | 1224.415 | 2.395 |
| 100 | 1224.70 | 2.11 | 1224.384 | 2.426 |
| 105 | 1224.72 | 2.09 | 1224.356 | 2.454 |
| 110 | 1224.70 | 2.11 | 1224.329 | 2.481 |
| 115 | 1224.74 | 2.07 | 1224.305 | 2.505 |
| 120 | 1224.79 | 2.02 | 1224.282 | 2.528 |
| 125 | 1224.81 | 2.00 | 1224.261 | 2.549 |
| 130 | 1224.80 | 2.01 | 1224.241 | 2.569 |
| 135 | 1224.83 | 1.98 | 1224.222 | 2.588 |
| 140 | 1224.82 | 1.99 | 1224.205 | 2.605 |
| 145 | 1224.86 | 1.95 | 1224.189 | 2.621 |
| 150 | 1224.85 | 1.96 | 1224.174 | 2.636 |
| 155 | 1224.88 | 1.93 | 1224.159 | 2.651 |
| 160 | 1224.87 | 1.94 | 1224.145 | 2.665 |
| 165 | 1224.86 | 1.95 | 1224.132 | 2.678 |
| 170 | 1224.94 | 1.87 | 1224.117 | 2.693 |
| 175 | 1224.93 | 1.88 | 1224.111 | 2.699 |
| 180 | 1224.92 | 1.89 | 1224.129 | 2.681 |
| 185 | 1224.92 | 1.89 | 1224.122 | 2.688 |
| 190 | 1224.90 | 1.91 | 1224.115 | 2.695 |
| 195 | 1224.99 | 1.82 | 1224.109 | 2.701 |
| 200 | 1224.96 | 1.85 | 1224.103 | 2.707 |
| 205 | 1224.94 | 1.87 | 1224.098 | 2.712 |
| 210 | 1224.92 | 1.89 | 1224.093 | 2.717 |
| 215 | 1224.96 | 1.85 | 1224.088 | 2.722 |
| 220 | 1224.95 | 1.86 | 1224.083 | 2.727 |
| 225 | 1224.97 | 1.84 | 1224.078 | 2.732 |
| 230 | 1224.95 | 1.86 | 1224.074 | 2.736 |
| 235 | 1224.97 | 1.84 | 1224.070 | 2.740 |
| 240 | 1224.93 | 1.88 | 1224.066 | 2.744 |
| 245 | 1224.93 | 1.88 | 1224.063 | 2.747 |
| 250 | 1224.94 | 1.87 | 1224.059 | 2.751 |
| 255 | 1224.95 | 1.86 | 1224.056 | 2.754 |
| 260 | 1224.93 | 1.88 | 1224.052 | 2.758 |
| 265 | 1224.94 | 1.87 | 1224.049 | 2.761 |
| 270 | 1224.95 | 1.86 | 1224.046 | 2.764 |
| 275 | 1224.97 | 1.84 | 1224.044 | 2.766 |
| 280 | 1224.92 | 1.89 | 1224.041 | 2.769 |
| 285 | 1224.96 | 1.85 | 1224.038 | 2.772 |
| 290 | 1224.93 | 1.88 | 1224.036 | 2.774 |
| 295 | 1224.95 | 1.86 | 1224.033 | 2.777 |
| 300 | 1224.91 | 1.90 | 1224.032 | 2.778 |
| 305 | 1224.95 | 1.86 | | — |
| 310 | 1224.92 | 1.89 | | — |
| 315 | 1224.95 | 1.86 | | — |
| 320 | 1224.94 | 1.87 | | — |
| 325 | 1224.93 | 1.88 | | — |
| 330 | 1224.97 | 1.84 | | — |
| 335 | 1224.94 | 1.87 | | — |
| 340 | 1224.96 | 1.85 | | — |
| 345 | 1224.94 | 1.87 | | — |
| 350 | 1224.96 | 1.85 | | — |
| 355 | 1224.99 | 1.82 | | — |
| 360 | 1224.96 | 1.83 | | — |

As shown in Table 1, an initial ground elevation He0 at the monitoring point is 1226.81; an average mining depth h of first mining nearby the monitoring point is 280 m, mining practice in the mining area has an advanced influence angle w of 62°, and an advanced influence distance L is calculated by using a formula $$L = \frac{h}{\tan w}$$

to obtain that L is 148.87 m. Therefore, when the mining advance distance moves forward to 150 m in front of the monitoring point to start to monitor a ground subsidence amount at the monitoring point. Manual monitoring is performed at a monitoring frequency of 2 times/d, where monitoring time points are respectively 6:00 and 18:00. The monitored data of the ground elevation He at the monitoring point is shown in Table 1. As shown in Table 1, the ground subsidence amount ΔH is calculated by using a formula ΔH=He0−He. The data is shown in Table 1. On May 8, 2017, a mining advance distance line exceeds the monitoring point by 300 m, and an accumulated ground subsidence amount continuously monitored in 5 days is less than 0.01 m, the ground subsidence becomes steady, and monitoring is stopped.

Figure 6:
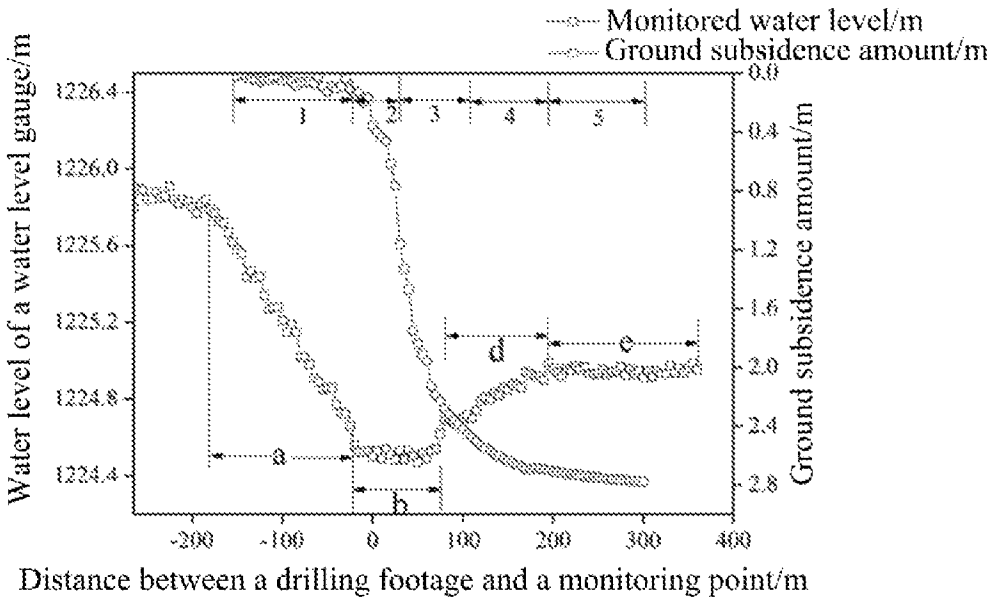
FIG. 6 shows variation relationship curves of mining advance distance and phreatic water level as well as mining advance distance and ground subsidence of a working face of a Jinjitan coal mine, in which a distance between a mining advance distance and a monitoring point being a negative value indicates that the monitoring point has not been mined, and the distance being a positive value indicates that the monitoring point has been mined.

Variation relationship curves of mining advance distance and phreatic water level as well as mining advance distance and ground subsidence are drawn according to the monitored data of Table 1, as shown in FIG. 6.

FIG. 6 is compared with FIG. 2, FIG. 3, and FIG. 4, and it is found that a curve variation law in FIG. 6 is similar to that in FIG. 3. Therefore, a phreatic leakage in the working face of the Jinjitan coal mine is determined to be a slight-phreatic leakage area.

In addition, to further determine a phreatic leakage disaster level of the working face of the Jinjitan coal mine, a water level buried depth in a loss process is compared with a local ecological water level buried depth. A formula for calculating a water level buried depth in a loss process is:

$S = He0 - Hw$, where

S is the water level buried depth, in m; He0 is the initial ground elevation at the monitoring point, in m; and Hw is a monitoring level of the telemetering water level gauge, in m.

A value range for calculating the water level buried depth S is 0.91 to 2.33, as shown in Table 1. In addition, the Jinjitan coal mine is located on an edge of the Mu Us desert, and the ground cover vegetation is mainly Shaliu and Saussure. According to the previous researches and previously published articles, "Study on Ecological Safe Groundwater Level Buried Depth in Windy Beach Area of Northern Shaanxi" and "Division of Coal Mining Conditions Based on Ecological Water Level Protection for Northern Shaanxi", it is determined that the local ecological water level buried depth is 3 m. Upon analysis, a calculated value of the water level buried depth S is less than the local ecological water level buried depth of 3 m. Further, the coal-mining working face of the Jinjitan coal mine is classified to be environmentally friendly. It can be seen that although the water level is slightly lowered in the mining process, vegetation would not be seriously affected.

In conclusion, in the present invention, a coal mining area is classified as a no-phreatic leakage area, a slight-phreatic leakage area, and a heavy-phreatic leakage area according to analysis on respective stages of ground subsidence amounts and monitored water level variations at an observation point and telemetering water, the coal mining area is classified into the no-phreatic leakage area, the slight-phreatic leakage area, and the heavy-phreatic leakage area; the calculated water level buried depth in the coal mining area loss process is compared with the local ecological water level buried depth, and the slight-phreatic leakage area is further classified as the environmentally friendly area and the environmental disaster area. The classifying method used in the present invention is simple and practical, where from a perspective of ecological protection, a water resource loss and an environmental disaster is determined for a shallow seam of a northwest coalfield, and a basis is provided for a choice of a mining manner in a mining area, and the method is of significance for ecological and environmental protection in a mining process of the northwest coalfield.

The descriptions above are merely specific preferred implementations of the present invention, and the protection scope of the present invention is not limited thereto. Any change or replacement that can be easily conceived of by a person skilled in the art within the scope of the technology disclosed by the present invention shall fall within the protection scope of the present invention.

What is claimed is:

1. A method for classifying a phreatic leakage disaster level in shallow coal seam mining, comprising the following steps:

S1. collecting a mine plan of a to-be-mined coal seam working face in a mining area, arranging a monitoring point, and burying a telemetering water level gauge to monitor a water level;

S2. according to the monitoring point arranged in the step S1, during mining of the to-be-mined coal seam working face, monitoring a ground elevation at the monitoring point, calculating a ground subsidence amount, and collecting information about a mining advance distance of the to-be-mined coal seam working face;

S3. plotting variation relationship curves of the mining advance distance and a phreatic water level, and the mining advance distance and a ground subsidence according to the mining advance distance and the ground subsidence amount obtained in the step S2 and the water level monitoring information obtained in the step S1; and S4. comparing the relationship curve with a no-phreatic leakage graph, a slight-phreatic leakage graph, and a heavy-phreatic leakage graph, and classifying a mined coal seam working face as a no-phreatic leakage area, a slight-phreatic leakage area, or a heavy-phreatic leakage area.

2. The method for classifying a phreatic leakage disaster level in shallow coal seam mining according to claim 1, wherein in the step S1, a location for arranging the monitoring point of the to-be-mined coal seam working face is located at the center of the to-be-mined coal seam working face, a buried depth of a probe of the telemetering water level gauge is below a monitored water level in a mining process, and water level monitoring is performed immediately after the telemetering water level gauge is completely buried.

3. The method for classifying a phreatic leakage disaster level in shallow coal seam mining according to claim 2, further comprising the following step:

S5. defining the no-phreatic leakage area as an environment friendly area, defining the heavy-phreatic leakage area as an environmental disaster area, calculating a water level buried depth of the slight-phreatic leakage area in the step S4, if the water level buried depth is deeper than a local ecological water level buried depth, classifying the mining coal seam working face as the environmental disaster area, and if the water level buried depth is shallower than the local ecological water level buried depth, classifying the mining coal seam working face as the environment friendly area.

4. The method for classifying a phreatic leakage disaster level in shallow coal seam mining according to claim 3, wherein a formula for calculating the water level buried depth of the slight-phreatic leakage area in the step S4 is $$S=He0-Hw,$$

wherein S is the water level buried depth, in meter; He0 is the initial ground elevation at the monitoring point, in meter; and Hw is a monitored water level of the telemetering water level gauge, in meter.

5. The method for classifying a phreatic leakage disaster level in shallow coal seam mining according to claim 1, wherein in the step S2, a formula for calculating the ground subsidence amount at the monitoring point is as follows:

$$\Delta H=He0-He, \text{ wherein}$$

ΔH is the ground subsidence amount, in meter; He0 is an initial ground elevation at the monitoring point, in meter; and He is a ground elevation at the monitoring point during a mining process, in meter.

6. The method for classifying a phreatic leakage disaster level in shallow coal seam mining according to claim 5, further comprising the following step:

S5. defining the no-phreatic leakage area as an environment friendly area, defining the heavy-phreatic leakage area as an environmental disaster area, calculating a water level buried depth of the slight-phreatic leakage area in the step S4, if the water level buried depth is deeper than a local ecological water level buried depth, classifying the mining coal seam working face as the environmental disaster area, and if the water level buried depth is shallower than the local ecological water level buried depth, classifying the mining coal seam working face as the environment friendly area.

7. The method for classifying a phreatic leakage disaster level in shallow coal seam mining according to claim 6, wherein a formula for calculating the water level buried depth of the slight-phreatic leakage area in the step S4 is $$S=He0-Hw,$$

wherein S is the water level buried depth, in meter; He0 is the initial ground elevation at the monitoring point, in meter; and Hw is a monitored water level of the telemetering water level gauge, in meter.

8. The method for classifying a phreatic leakage disaster level in shallow coal seam mining according to claim 1, wherein in the step S2, a precision of monitoring of the ground elevation at the monitoring point is 0.001 m.

9. The method for classifying a phreatic leakage disaster level in shallow coal seam mining according to claim 8, further comprising the following step:

S5. defining the no-phreatic leakage area as an environment friendly area, defining the heavy-phreatic leakage area as an environmental disaster area, calculating a water level buried depth of the slight-phreatic leakage area in the step S4, if the water level buried depth is deeper than a local ecological water level buried depth, classifying the mining coal seam working face as the environmental disaster area, and if the water level buried depth is shallower than the local ecological water level buried depth, classifying the mining coal seam working face as the environment friendly area.

10. The method for classifying a phreatic leakage disaster level in shallow coal seam mining according to claim 9, wherein a formula for calculating the water level buried depth of the slight-phreatic leakage area in the step S4 is $$S=He0-Hw,$$

wherein S is the water level buried depth, in meter; He0 is the initial ground elevation at the monitoring point, in meter; and Hw is a monitored water level of the telemetering water level gauge, in meter.

11. The method for classifying a phreatic leakage disaster level in shallow coal seam mining according to claim 1, wherein in the step S4, a ground subsidence variation curve in the no-phreatic leakage graph, the slight-phreatic leakage graph, and the heavy-phreatic leakage graph is divided into five stages including a non-subsiding stage, a slow subsiding stage, an accelerated subsiding stage, a slowed-down subsiding stage, and a steady subsiding stage; and a water level variation curve in the no-phreatic leakage graph is divided into: a rapid water level lowering stage, a transient steady water level stage, a rapid water level rising stage, a slow water level rising stage, and a steady water level stage; a water level variation curve in the slight-phreatic leakage graph is divided into: a rapid water level lowering stage, a transient steady water level stage, a slow water level rising stage, and a steady water level stage; and a water level variation curve in the heavy-phreatic leakage graph is divided into: rapid water level lowering stage.

12. The method for classifying a phreatic leakage disaster level in shallow coal seam mining according to claim 11, further comprising the following step:

S5. defining the no-phreatic leakage area as an environment friendly area, defining the heavy-phreatic leakage area as an environmental disaster area, calculating a water level buried depth of the slight-phreatic leakage area in the step S4, if the water level buried depth is deeper than a local ecological water level buried depth, classifying the mining coal seam working face as the environmental disaster area, and if the water level buried depth is shallower than the local ecological water level buried depth, classifying the mining coal seam working face as the environment friendly area.

13. The method for classifying a phreatic leakage disaster level in shallow coal seam mining according to claim 12, wherein a formula for calculating the water level buried depth of the slight-phreatic leakage area in the step S4 is $$S=He0-Hw,$$

wherein S is the water level buried depth, in meter; He0 is the initial ground elevation at the monitoring point, in meter; and Hw is a monitored water level of the telemetering water level gauge, in meter.

14. The method for classifying a phreatic leakage disaster level in shallow coal seam mining according to claim 1, further comprising the following step:

S5. defining the no-phreatic leakage area as an environment friendly area, defining the heavy-phreatic leakage area as an environmental disaster area, calculating a water level buried depth of the slight-phreatic leakage area in the step S4, if the water level buried depth is deeper than a local ecological water level buried depth, classifying the mining coal seam working face as the environmental disaster area, and if the water level buried depth is shallower than the local ecological water level buried depth, classifying the mining coal seam working face as the environment friendly area.

15. The method for classifying a phreatic leakage disaster level in shallow coal seam mining according to claim 14, wherein a formula for calculating the water level buried depth of the slight-phreatic leakage area in the step S4 is $$S=He0-Hw,$$

wherein S is the water level buried depth, in meter; He0 is the initial ground elevation at the monitoring point, in meter; and Hw is a monitored water level of the telemetering water level gauge, in meter.

16. The method for classifying a phreatic leakage disaster level in shallow coal seam mining according to claim 14, wherein the ecological water level is a groundwater level buried depth capable of maintaining good development and growth of typical vegetation, and the ecological water level is determined according to typical ground cover vegetation of the coal mining area.

* * * * *